US011253047B1

(12) United States Patent
Rome et al.

(10) Patent No.: US 11,253,047 B1
(45) Date of Patent: Feb. 22, 2022

(54) SUSPENDED LOAD BACKPACK

(71) Applicant: Hoverglide, Inc., Strafford, PA (US)

(72) Inventors: Lawrence C. Rome, Strafford, PA (US); Sean H. McIntosh, Drexel Hill, PA (US)

(73) Assignee: Hoverglide Inc., Stafford, PA (US)

( * ) Notice: Subject to any disclaimer, the term of this patent is extended or adjusted under 35 U.S.C. 154(b) by 86 days.

(21) Appl. No.: 16/548,452

(22) Filed: Aug. 22, 2019

Related U.S. Application Data

(60) Provisional application No. 62/721,109, filed on Aug. 22, 2018.

(51) Int. Cl.

| | |
|---|---|
| ***A45F 3/04*** | (2006.01) |
| ***A45F 3/10*** | (2006.01) |
| ***A45F 3/08*** | (2006.01) |
| ***A45F 3/00*** | (2006.01) |

(52) U.S. Cl.
CPC ..... *A45F 3/047* (2013.01); *A45F 3/08* (2013.01); *A45F 3/10* (2013.01); *A45F 2003/006* (2013.01)

(58) Field of Classification Search
CPC ..... A45F 3/047; A45F 3/08; A45F 3/10
USPC ..... 224/634, 633, 637
See application file for complete search history.

(56) References Cited

U.S. PATENT DOCUMENTS 4,168,793 A * 9/1979 Knight ..... A45F 3/14 224/157
5,284,279 A * 2/1994 Sason ..... A45F 3/047 224/632
5,449,102 A * 9/1995 Sason ..... A45F 3/047 224/632
5,730,347 A * 3/1998 Finot ..... A45F 3/047 224/628
5,971,244 A * 10/1999 Jaeger ..... A45F 3/08 224/632
6,982,497 B2 * 1/2006 Rome ..... A45F 3/08 224/579
7,152,771 B2 * 12/2006 Le Gal ..... A45F 3/047 224/631

(Continued)

FOREIGN PATENT DOCUMENTS

WO WO-2004082427 A2 * 9/2004 ..... A45F 3/08
WO WO-2008076932 A3 * 10/2008 ..... A45F 3/04

(Continued)

*Primary Examiner* — Nathan J Newhouse
*Assistant Examiner* — Lester L Vanterpool
(74) *Attorney, Agent, or Firm* — Culhane Meadows, PLLC

(57) ABSTRACT

A suspended load backpack includes a moving frame including a bag for receiving a load to be carried by the backpack, a fixed frame including shoulder straps for holding the fixed frame in place on a wearer's back, and a rail assembly that connects the moving frame to the fixed frame but allows the moving frame to move relative to the fixed frame. A mounting wheel is connected to the fixed frame, and a compliant mechanism such as a bungee cord is connected between the fixed frame and the moving frame and wrapped around the mounting wheel to permit movement of the moving frame relative to the fixed frame during a gait of the wearer of the backpack in accordance with tension on the compliant mechanism. A ratchet assembly includes a lever that rotates the mounting wheel to easily apply tension to the compliant mechanism.

14 Claims, 9 Drawing Sheets

(56) References Cited

U.S. PATENT DOCUMENTS 7,562,862 B1 * 7/2009 Jackson ..... B66D 3/14 254/333
7,851,932 B2 * 12/2010 Rome ..... F03G 5/00 290/10
7,931,178 B2 * 4/2011 Rome ..... A45F 3/08 224/634
7,946,460 B2 * 5/2011 Yip ..... A45F 3/047 224/631
8,172,117 B2 * 5/2012 Maggi ..... A45F 3/08 224/634
10,342,318 B2 * 7/2019 Winfield ..... A45F 3/047
2003/0010861 A1 * 1/2003 Tsan ..... A45C 13/26 242/385.3
2004/0183306 A1 * 9/2004 Rome ..... F03G 5/06 290/1 R
2005/0045686 A1 * 3/2005 Yeh ..... A45F 3/047 224/632
2006/0138167 A1 * 6/2006 McMahon ..... A47G 19/183 222/100
2008/0185411 A1 * 8/2008 Rome ..... F03G 5/06 224/633
2009/0015022 A1 * 1/2009 Rome ..... F03G 5/00 290/1 A
2011/0198377 A1 * 8/2011 Froidevaux ..... A45F 3/08 224/633
2014/0008593 A1 * 1/2014 Kingery ..... B66D 3/02 254/376
2015/0117975 A1 * 4/2015 Wright ..... B60P 7/0846 410/103

FOREIGN PATENT DOCUMENTS

WO WO-2008121954 A1 * 10/2008 ..... F03G 5/00
WO WO-2009024727 A2 * 2/2009 ..... A45F 3/08
WO WO-2012153334 A1 * 11/2012 ..... A45F 3/08

* cited by examiner

SUSPENDED LOAD BACKPACK

CROSS-REFERENCE TO RELATED APPLICATIONS

The present application claims priority under 35 U.S.C. § 119(e) to U.S. Provisional Patent Application No. 62/721,109, filed Aug. 22, 2018, the contents of which are incorporated herein by reference.

FIELD

This document pertains generally, but not by way of limitation, to an ergonomic backpack and, more particularly, to a backpack that suspends the load from a frame that moves up and down relative to the wearer's body as the wearer walks or runs to significantly reduce the forces on the wearer's body.

BACKGROUND

U.S. Pat. No. 7,931,178 to the present inventor describes a suspended load ergonomic backpack that reduces the forces applied to a wearer's body by suspending the entire load carrying bag from a suspension system having two frames, one relatively fixed to the body, and a moving frame that supports the load and moves relative to the fixed frame by virtue of the give in a compliant coupling. As illustrated in FIG. 1, the suspended load backpack 10 includes a suspension system 30 including a compliant coupling, such as the illustrated bungee cord 20 wrapped around low-friction pulleys 40 to allow the load to move relative to the fixed portion of the suspension system 30. As illustrated, the suspension system 30 is connected directly or indirectly to shoulder straps 50 on one side and, on the opposite side, to the load storage bag 60 for carrying the load. The suspension system 30 includes a suspension cassette containing the compliant coupling, for example, a bungee cord 20 that is run over several low friction pulleys 40 to get the length necessary for a relatively large compliance. The bungee cord 20 allows the load to move relative to the fixed portion of the suspension system 30, and a cleat is used to adjust the spring constant for different weights and stiffnesses by adjusting the length of the bungee cord 20 and cleating it in place. The suspension system 30 also includes bushings 70 that run up and down vertical rods 80. Vertical movement of bushings 70 on vertical rods 80 is limited by stops 90 at the top and bottom of the vertical rods 80. A moving plate 100 made of a light, but sturdy, material such as aluminum is connected so as to move up and down with the bushings 70 as they slide on the vertical rods 80 as a result of the load in the load storage bag 60 connected to the plate 100. A fixed plate 110 may optionally be provided on the side of the suspension system 30 facing the wearer. Fixed plate 110 prevents the wearer's clothing from interfering with the operation of the low-friction pulleys 40 and bungee cord 20. In addition, the entire suspension system 30 may optionally be encased in a cloth mesh or plastic cover 120 on the top, bottom, and sides so as to further prevent frictional contact with the low-friction pulleys 40 and bungee cord and to prevent mud, sand, and the like from affecting the operation of the pulleys 40. The cover 120 is stripped away for ease of illustration.

For larger and heavy-duty day packs, a frame structure 130 is optionally provided to support the suspension system 30 and to connect the suspension system 30 to the shoulder straps 50. The frame structure 130 may contain pads at points of contact with the wearer. The pads may provide connection points for the shoulder straps 50. However, for lighter duty day packs for students, the suspension system 30 may connect directly to the shoulder straps 50 and/or a panel integral with the shoulder straps 50.

Though the suspended load ergonomic backpack described in U.S. Pat. No. 7,931,178 performs quite well, there are several features that could be improved. The present application describes such improvements.

SUMMARY

During use of the suspended load ergonomic backpack described in U.S. Pat. No. 7,931,178, several issues with the original design have led to design improvements. For example, it has proven to be difficult to tension the bungee cord, particularly while wearing the backpack. Also, there is no convenient place to stow the excess bungee cord when the bungee cord is tightened. There also is no easy way to automatically lock the backpack to prevent movement. Also, it has become desirable to redesign the frames of the backpack to prevent separation, to reduce the height of the frame, to modify the bushings and rods system to simplify cleaning, and to simplify and lighten the rods or replace them with a lighter track system.

The suspended load backpack described herein addresses these and other issues by providing a tensioning device that uses a ratchet crank mechanism to give the user sufficient mechanical advantage to easily tension the bungee. An extra pulley also enables a shorter frame to be used that makes the backpack less cumbersome and more practical. A tube is also provided to stow the excess bungee cord when the bungee cord is tightened. A user-friendly lock enables the user to lock the backpack manually while on the wearer's back. Also, an automatic locking mechanism may lock the backpack movement when the load hits the top of the frame. A new rail design further prevents the backpack from breaking apart in certain loading conditions and makes the backpack less expensive, lighter, and easier to manufacture.

In sample embodiments, a suspended load backpack is provided that includes a moving frame including a bag for receiving a load to be carried by the backpack, a fixed frame including shoulder straps for holding the fixed frame in place on a wearer's back, and a rail assembly that connects the moving frame to the fixed frame but allows the moving frame to move relative to the fixed frame. A mounting wheel is connected to the fixed frame and receives a compliant mechanism that is connected between the fixed frame and the moving frame and wrapped around the mounting wheel to permit movement of the moving frame relative to the fixed frame during a gait of the wearer of the backpack in accordance with tension on the compliant mechanism. A ratchet assembly is further provided that includes a lever that rotates the mounting wheel to apply tension to the compliant mechanism. In the sample embodiments, the compliant mechanism is a bungee cord, and a tube is provided adjacent to the mounting wheel and adapted to receive the bungee cord as the bungee cord is extended during ratcheting by the ratchet assembly.

In other embodiments, the ratchet assembly includes a ratchet wheel, a first pawl attached to the lever and that provides a mechanical connection between the mounting wheel and the lever, a first pawl spring that keeps the first pawl engaged with the mounting wheel when the lever is being rotated to an initial position, a second pawl attached to the fixed frame so as to prevent the mounting wheel from spinning while the lever is advanced to the initial position, and a second pawl spring that keeps the second pawl engaged with the mounting wheel when the lever is being rotated to the initial position. When the compliant mechanism is a bungee cord, movement of the lever may crank the mounting wheel to apply tension to the bungee cord as the mounting wheel rotates about a shaft mounted to the fixed frame as the lever rotates about the shaft. The first pawl may be mounted so as to engage the mounting wheel as the lever rotates the mounting wheel to apply tension to the bungee cord. The ratchet assembly may be located at a bottom of the fixed frame to enable easier access to the lever while the backpack is being worn.

In further embodiments, a locking mechanism is provided that locks the moving frame to the fixed frame at first and second locking positions to prevent movement. The locking mechanism may include a lock latch connected to the fixed frame via a lock pivot pin that allows the lock latch to swing and to engage a lock recess at the first and second positions in the moving frame. The lock latch may also include a recess that receives a catch that is configured to rotate in a perpendicular plane relative to the lock latch in order to engage with the lock recess in a locked position. The catch may also rotate in the perpendicular plane relative to the lock latch in order to disengage with the lock recess in an unlocked position and to rotate so as to prevent the lock latch from rotating back into the locked position. A spring-loaded latch may also be provided that automatically engages to lock the moving frame relative to the fixed frame at a topmost position of movement of the moving frame relative to the fixed frame to prevent rapid oscillation of the load in certain situations, as the load exerts force at the same time as the wearer when, for example, the wearer jumps down while wearing the backpack.

In still further embodiments, the rail assembly includes at least one rail mounted to the fixed frame and wheels connected to the moving frame. In sample embodiments, the wheels are disposed on three sides of the at least one rail to limit lateral movement of the moving frame relative to the at least one rail. The rail assembly may include at least one rail molded integrally with the fixed frame or at least one rail mounted to the fixed frame at a top and bottom of the rail. The backpack may also include at least two pulleys around which the bungee cord is wound in order to enable use of a longer bungee cord with a shorter fixed frame, thus making the resulting backpack more suitable for use as a smaller day pack.

BRIEF DESCRIPTION OF DRAWINGS

In the drawings, which are not necessarily drawn to scale, like numerals may describe similar components in different views. Like numerals having different letter suffixes may represent different instances of similar components. Some embodiments are illustrated by way of example, and not of limitation, in the figures of the accompanying drawings.

DESCRIPTION

Figure 1:
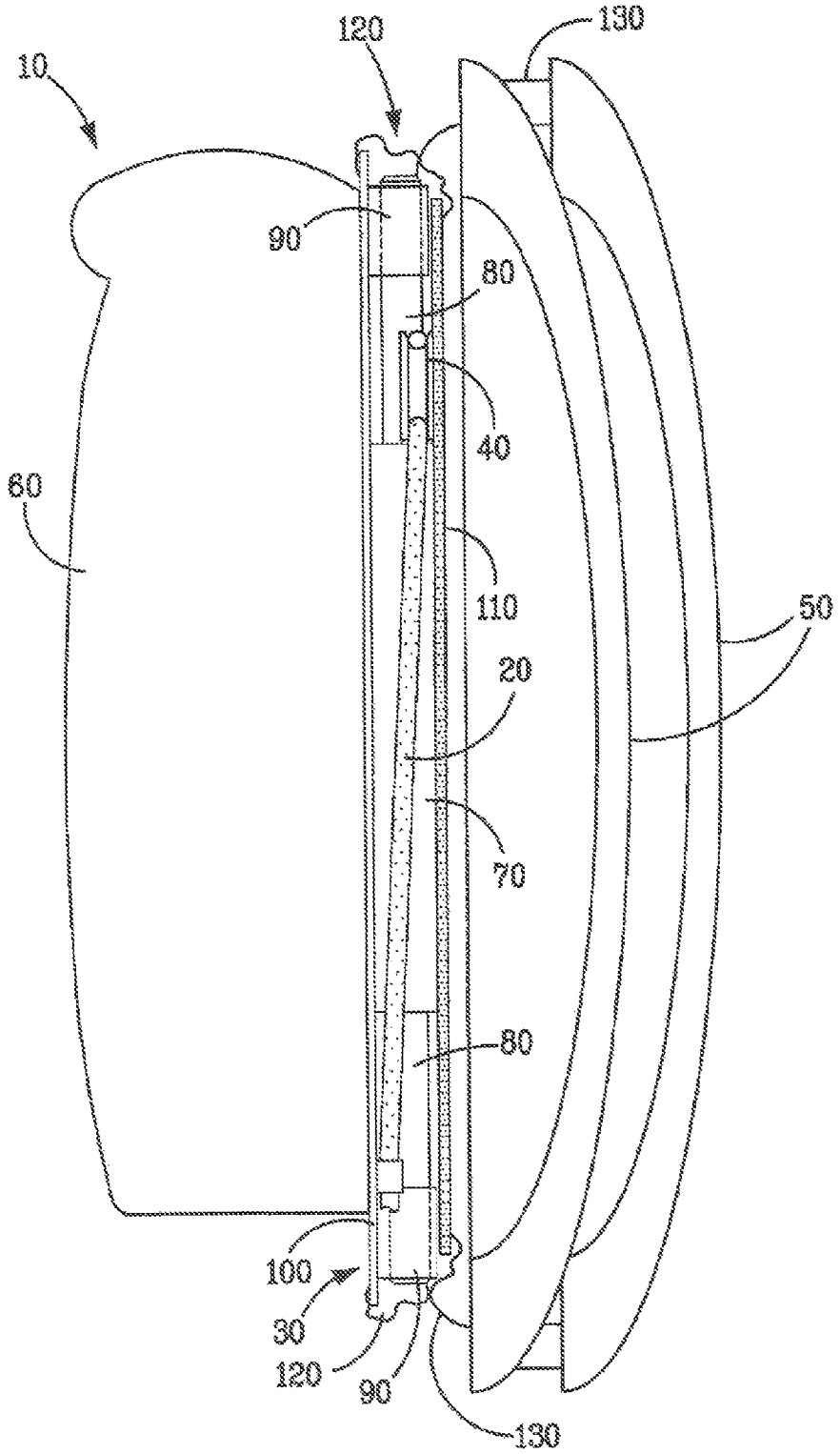
FIG. 1 PRIOR ART
FIG. 1 is a side view of a day pack described in U.S. Pat. No. 7,931,178.

Reference now will be made in detail to embodiments, one or more example(s) of which are illustrated in the drawings. Each example is provided by way of explanation of the embodiments, not limitation of the present disclosure. It will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

The suspended load backpack described herein provides significant enhancements to the operation of the suspended load ergonomic backpack described in U.S. Pat. No. 7,931,178. As will be explained in more detail below, the backpack described herein provides a tensioning device that uses a ratchet crank mechanism to give the user sufficient mechanical advantage to easily tension the bungee. Extra pulleys enable a shorter frame to be used that makes the backpack less cumbersome and more practical. A tube is also provided to stow the excess bungee cord when the bungee cord is tightened. A user-friendly lock enables the user to lock the backpack manually. Also, an automatic locking mechanism may lock the backpack movement when the load hits the top of the frame. A new rail design further prevents the backpack from breaking apart in certain loading conditions and makes the backpack less expensive, lighter, and easier to manufacture.

Figure 2:
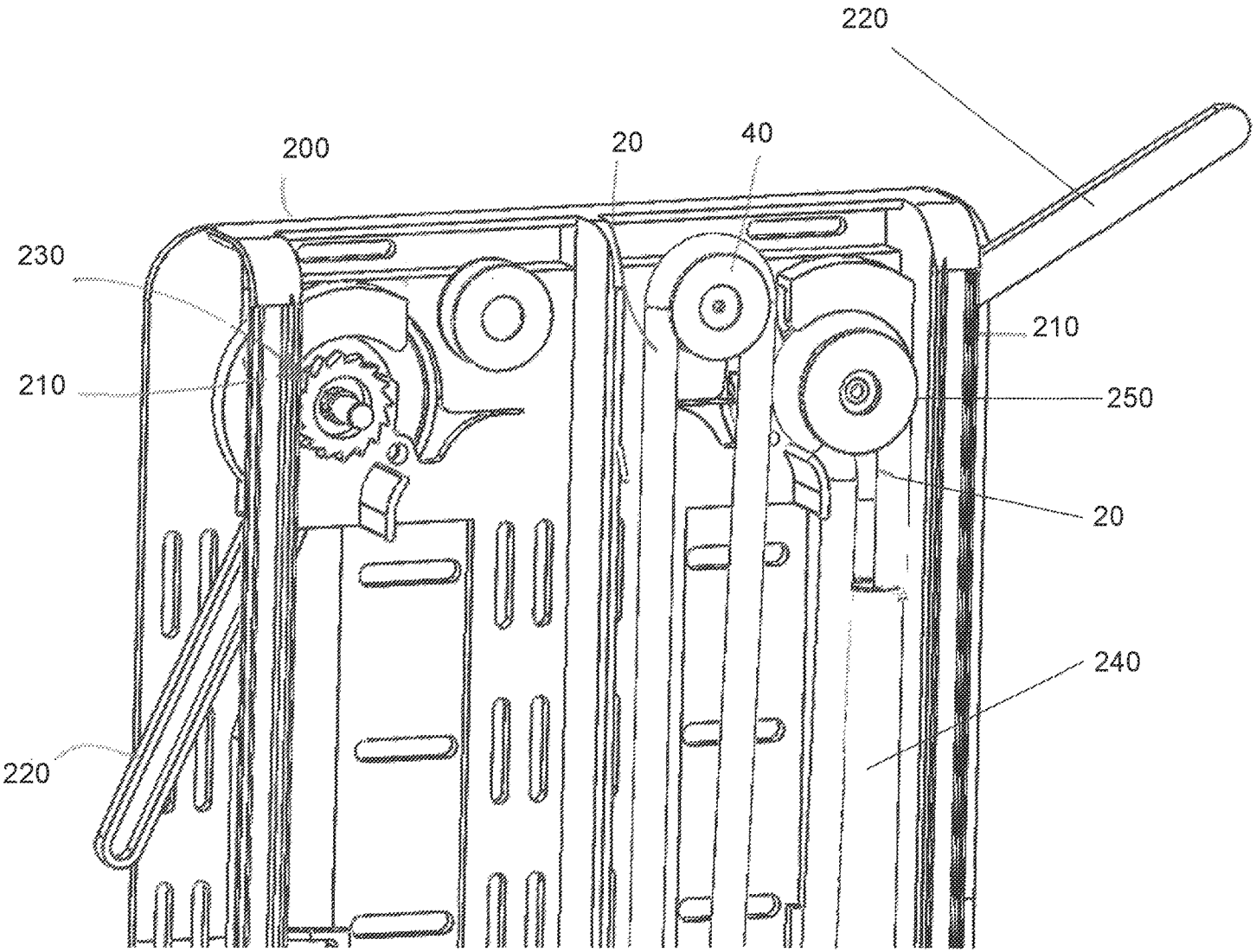
FIG. 2 is a cutaway view of the bungee cord and pulley system adapted to include a ratchet mechanism in a sample embodiment.

In the suspended load ergonomic backpack described in U.S. Pat. No. 7,931,178, the bungee cords could be manually adjusted by pulling the bungee cords by hand while a cam clamped the end. This manual process was often difficult and required significant strength, particularly at the end of the tensioning process when the bungee cord is under considerable tension. Also, since there was no stowage mechanism for the excess bungee cord, the excess bungee cord could flop around and sometimes could prohibit movement of the load along the rail. FIG. 2 is a cutaway view of a bungee cord and pulley system that addresses these problems by using a ratchet mechanism in a sample embodiment.

As illustrated in FIG. 2, the fixed frame 200 is connected to the backpack harness including the shoulder straps and houses the bungee cord 20 and the low friction pulleys 40 around which the bungee cord 20 is mounted for tension adjustment to regulate movement of the moving frame including the load along the rails 210 relative to the fixed frame 200. As illustrated, the bungee cord tensioning device includes a ratchet crank mechanism including ratchet wheel handle or lever 220 that gives the user sufficient mechanical advantage to easily tension the bungee cord 20. The low friction pulley 40 is removed on the left-hand side of FIG. 2 so that the underlying ratchet mechanism 230 cranked by the ratchet wheel handle 220 is visible. The embodiment of FIG. 2 includes two identical bungee systems in parallel to provide a greater range of forces. A lightweight plastic bungee cord tube 240 with a diameter slightly larger than the bungee cord 20 also may be mounted onto the fixed frame 200 such that a mouth of the bungee cord tube 240 is positioned just below the bungee cord mounting wheel 250 to receive the end of the bungee cord 20 as the bungee cord 20 is extended during ratcheting. The bungee cord 20 exits the bungee cord mounting wheel 250 and enters the bungee cord tube 240 where the excess bungee cord 20 is neatly stowed. The bungee cord tube 240 thus keeps the excess bungee cord 20 from flopping around and getting caught between the fixed frame 200 and the moving frame when the moving frame slides along the rails 210. In sample embodiments, the moving frame includes the bag for accepting a load for the backpack and is connected to the fixed frame 200 via the bungee cords 20, the rails 210 and bearings (wheels) as described in more detail below.

The ratchet crank mechanism 230 cranked by the ratchet wheel handle 220 allows for easy tensioning of the bungee cord 20. The bungee cord 20 wraps around the bungee cord mounting wheel 250 that holds the bungee cord 20, and the ratchet wheel handle 220 is attached to the bungee cord mounting wheel 250 so that the bungee cord mounting wheel 250 may be rotated to advance the bungee cord 20. As the bungee cord 20 is advanced, the end of the bungee cord 20 is fed into the bungee cord tube 240. The ratchet mechanism 230 holds the bungee cord mounting wheel 250 in place while the ratchet wheel handle 220 is rotated to its initial position allowing the process to be repeated until the bungee cord 20 is sufficiently tensioned (a mark on the frame 200 may be used to indicate when the bungee cord 20 is sufficiently tensioned).

Figure 3:
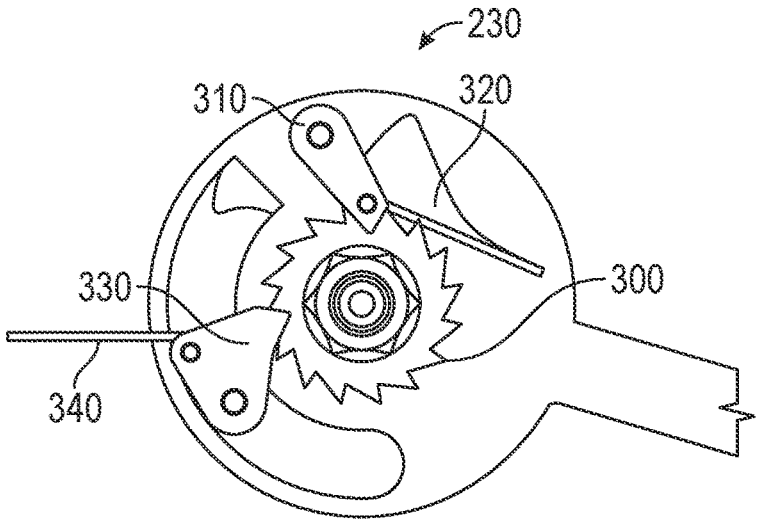
FIG. 3 is an enlarged view of the ratchet mechanism illustrated in FIG. 2.

FIG. 3 is an enlarged view of the ratchet mechanism 230 illustrated in FIG. 2. As shown, the ratchet mechanism 230 includes a ratchet wheel 300, a first pawl 310, a first pawl spring 320, a second pawl 330, and a second pawl spring 340. The pawl springs 320 and 340 bias the pawls 310 and 330 to engage the teeth of the ratchet 300 in a conventional manner as the ratchet wheel 300 is rotated by the force of the ratchet wheel handle 220. The first pawl 310 is attached to the ratchet wheel handle 220 but is free to rotate relative to the ratchet wheel handle 220. First pawl 310 is the mechanical connection between the ratchet wheel handle 220 and the bungee cord mounting wheel 250. The first pawl spring 320 keeps the first pawl 310 engaged into the teeth of the bungee cord mounting wheel 250 when the ratchet wheel handle 220 is being rotated upwards to its initial position. The second pawl 330 is attached to the fixed frame 200 but is to free to rotate relative to the fixed frame 200. The second pawl 330 prevents the bungee cord mounting wheel 250 from spinning while the ratchet wheel handle 220 is advanced to its original position. The second pawl spring 340 keeps the second pawl 330 engaged into the teeth of the bungee cord mounting wheel 250 when the ratchet wheel handle 220 is being rotated upwards to its initial position.

During use, the ratchet wheel handle 220 is cranked to tension the bungee cord 20. The user cranks the ratchet wheel handle 220 up and down to rotate the bungee cord mounting wheel 250 by the ratchet wheel via pawl 320 attached to the ratchet wheel handle 220. The bungee cord 20 wraps around the bungee cord mounting wheel 250 and holds onto the bungee cord 20 via a number of vanes in the cavity of the bungee cord mounting wheel 250. The bungee cord 20 thus wraps around the bungee cord mounting wheel 250 and is kept from slipping on the bungee cord mounting wheel 250 via the vanes molded into the bungee cord mounting wheel 250. The bungee cord mounting wheel 250 rotates about a shaft mounted to the fixed frame 200 of the backpack. The ratchet wheel handle 220 is used to turn the bungee cord mounting wheel 250, and the ratchet wheel handle 220 rotates about the same shaft used to mount the bungee cord mounting wheel 250. The pawl 310 mounted to the ratchet wheel handle 220 engages the teeth molded into the bungee cord mounting wheel 250 as the ratchet wheel handle 220 is pulled down to rotate the bungee cord mounting wheel 250 thus tensioning the bungee cord 20. When the ratchet wheel handle 220 is brought down as far as it will go, the second pawl 330 engages the same teeth molded into the bungee cord mounting wheel 250. The ratchet wheel handle 220 can now be brought back up to the original position while the second pawl 330 holds the bungee cord mounting wheel 250 in place and prevents it from rotating. The ratchet wheel handle 220 can be brought down again further tensioning the bungee cord 20. This process is repeated until the bungee cord 20 is properly tensioned. The tension on bungee cord 20 is released by moving the ratchet wheel handle 220 to an extreme position to disengage both pawls so that the bungee cord mounting wheel 250 is able to spin and reduce (or release) the tension in the bungee cord 20.

Figure 4:
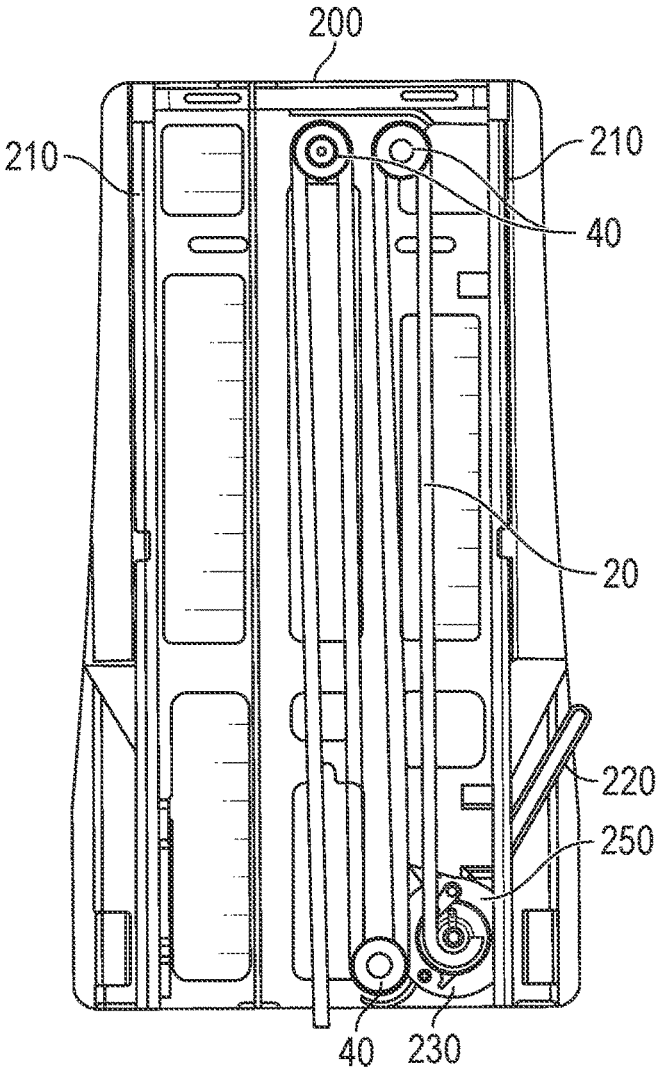
FIG. 4 illustrates an alternative embodiment of the bungee cord and pulley system of FIG. 2 where the ratchet mechanism has been moved to the bottom of the backpack frame for easier user access while wearing the backpack.

FIG. 4 illustrates an alternative embodiment of the bungee cord and pulley system of FIG. 2 where the ratchet mechanism 230 has been moved to the bottom of the fixed frame 200 for easier user access to tension the bungee cord 20 while wearing the backpack. Also, FIG. 4 illustrates and embodiment with only a single bungee system traveling over 3 pulleys 40, though parallel bungee systems could be used as in the embodiment of FIG. 2. Though not shown, as the bungee cord 20 exits the ratcheting mechanism 230 it enters the bungee cord tube 240 where the excess bungee cord 20 is neatly stowed. In this case, the excess bungee cord 20 is forced upwards against gravity or along the bottom of the fixed frame 200 so that the bungee cord tube 240 guides the excess bungee cord 20 away from the rails 210 to prevent the excess bungee cord 20 from getting caught between the fixed frame 200 and the moving frame when the moving frame slides along the rails 210.

Figure 5A:
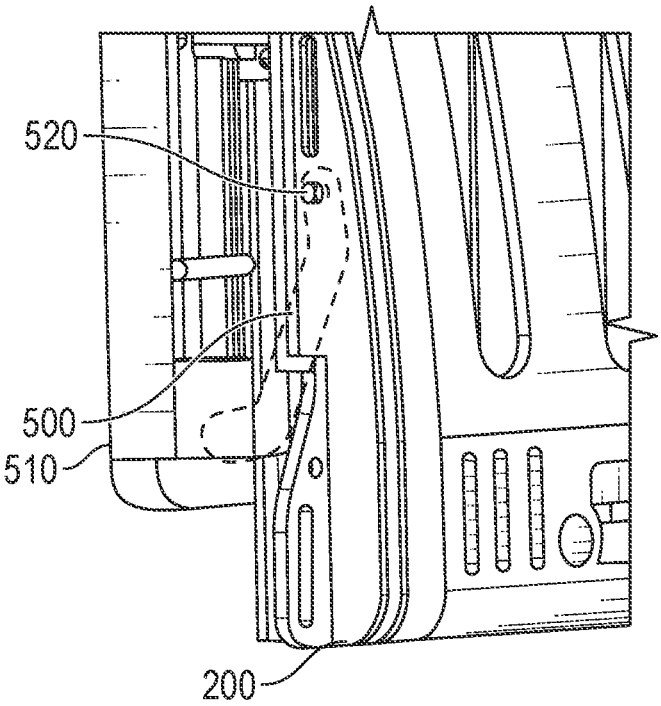
FIG. 5A illustrates a sample embodiment of a manual locking mechanism in a locked position.
Figure 5B:
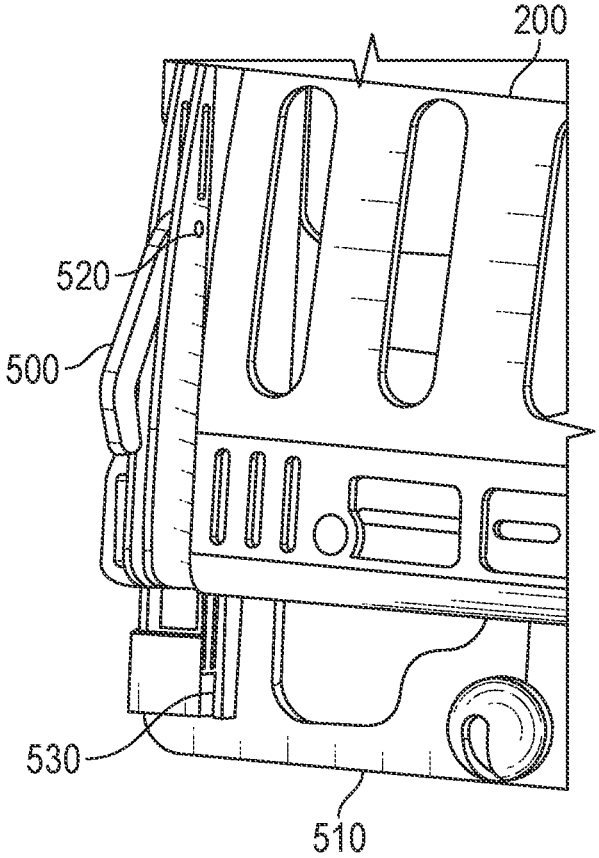
FIG. 5B illustrates the sample embodiment of the manual locking mechanism of FIG. 5A in an unlocked position.

FIG. 5A illustrates a sample embodiment of a manual locking mechanism in a locked position, while FIG. 5B illustrates the sample embodiment of the manual locking mechanism of FIG. 5A in an unlocked position. As illustrated, the lock latch 500 swings between the moving frame 510 and the fixed frame 200, locking the two frames together and preventing relative motion. Lock pivot pin 520 attaches the lock latch 500 to the fixed frame 200 and allows the lock latch 500 to swing and to engage a lock recess 530 in the moving frame 510 to prevent relative motion between the two frames. Lock recess 530 is shown in FIG. 5B where the moving frame 510 is in an upward position relative to the fixed frame 200.

Figure 6:
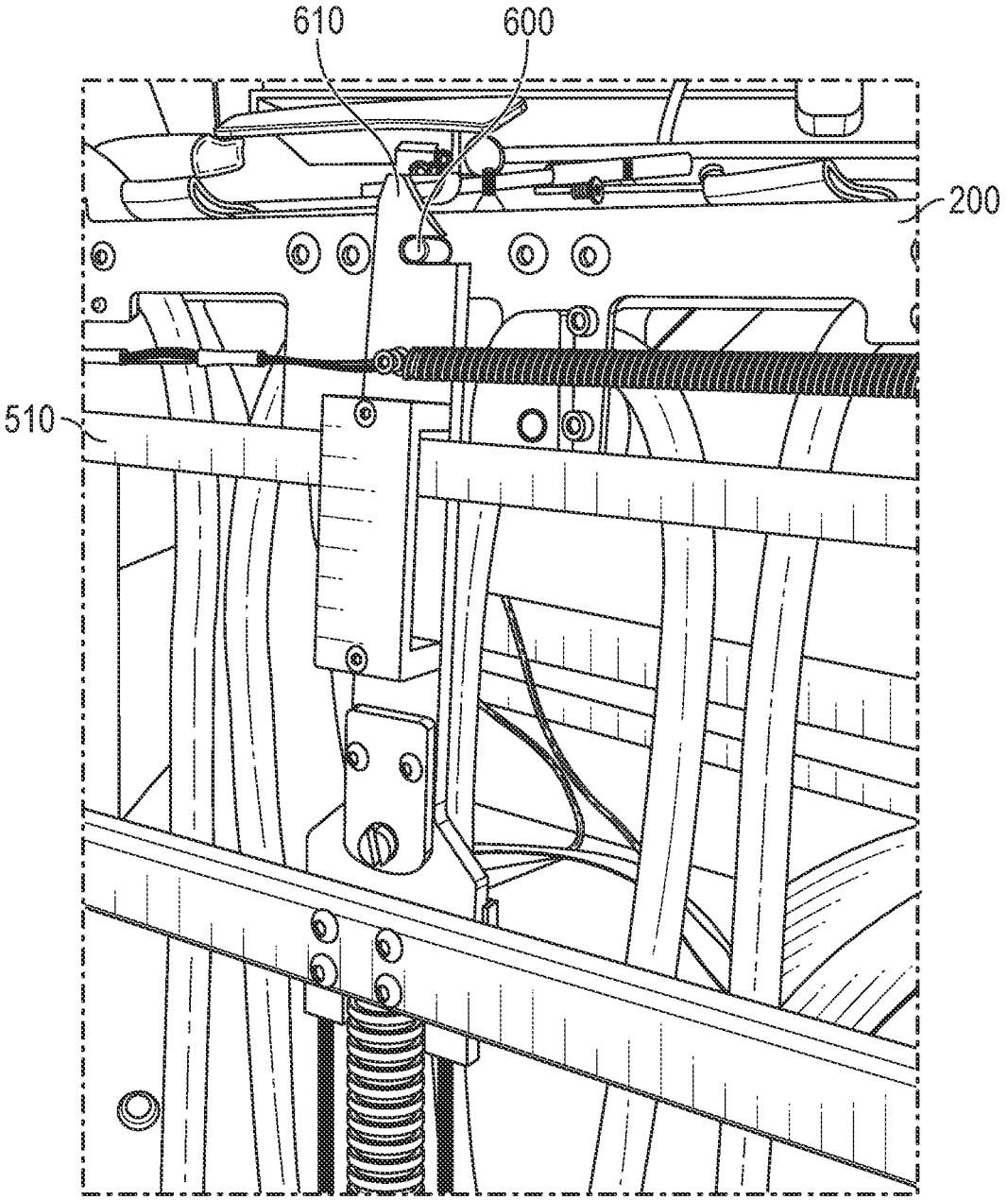
FIG. 6 illustrates an embodiment of the moving frame at a topmost position relative to the fixed frame and engaged (locked) by a latch pin.

FIG. 6 illustrates an embodiment of the moving frame 510 at a topmost position relative to the fixed frame 200 and engaged by a latch pin 600. The latch pin 600 is attached to the fixed frame 200 and automatically engages at the very top of travel of the moving frame 510 relative to the fixed frame 200. The latch 610 is attached to a spring and to the moving frame 510 and moves to the left as it moves up and hits the latch pin 600. Once the latch 610 moves high enough, the latch pin 600 engages in the slot as the spring-loaded latch 610 moves back to the right. The latch 610 is disengaged by pulling a cord (not shown) attached to the shoulder harness. The spring-loaded latch 610 thus locks the moving frame 510 relative to the fixed frame by engaging with the latch pin 600 during significant movement such as when the wearer jumps down, thereby causing the moving frame 510 to move upward relative to the fixed frame 200. Automatic locking at the top of the fixed frame 200 allows the load to exert force at the same time as the wearer. Locking the moving frame 510 causes the moving frame 510 to stay at a constant height as the fixed frame 200 and the wearer accelerate down and hit the moving frame 510.

Also, a second mechanical lock may be engaged manually by swinging a second lever into another slot in the moving frame 510. This allows the backpack to have two locked positions. In one locked position, the moving frame 200 may be flush with the fixed frame 510 so that the backpack may stand up when off the wearer's back. However, walking around with the load so low would be uncomfortable, so a second locking position may be provided to lock the load in a higher position at a typical height where the wearer would carry the load in the moving frame 510.

Figure 7A:
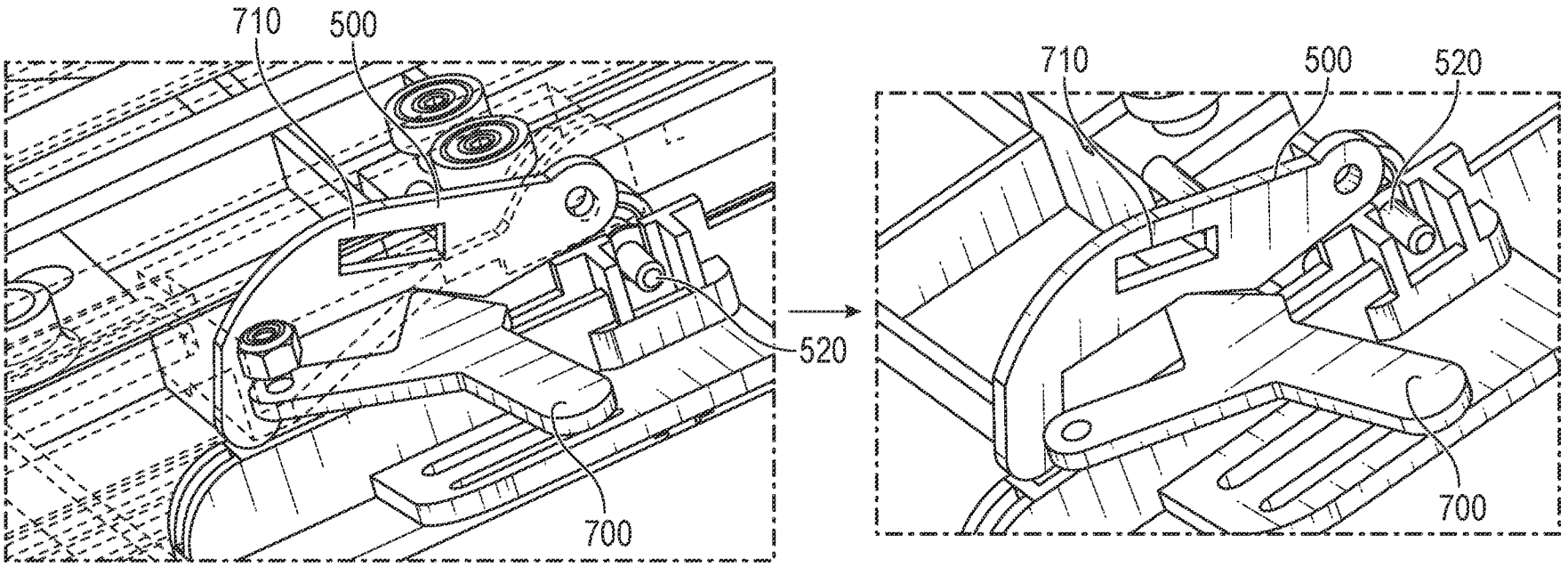
FIGS. 7A and 7B together illustrate the operation of the manual locking mechanism of FIGS. 5A and 5B in a sample embodiment.
Figure 7B:
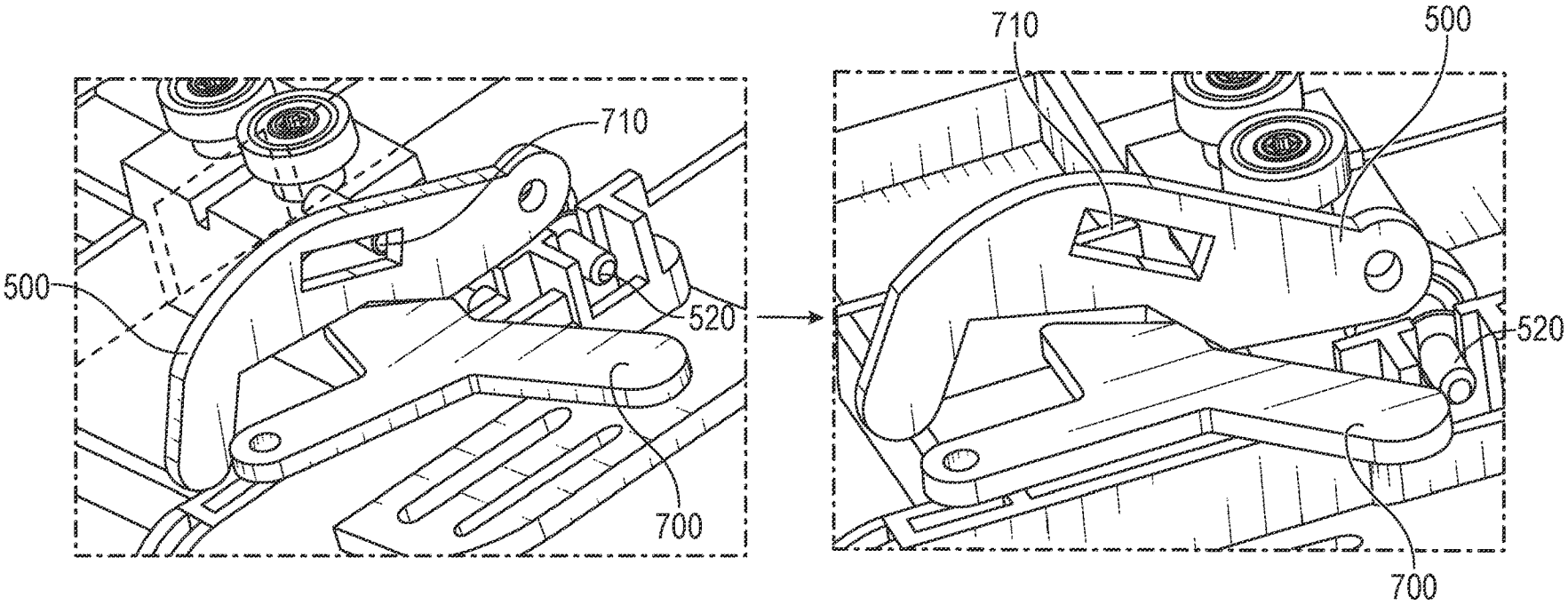

FIGS. 7A and 7B together illustrate the operation of the manual locking mechanism of FIGS. 5A and 5B in a sample embodiment. As illustrated in FIG. 7A, the lock latch 500 rotates around a pivot point of lock pivot pin 520. The catch 700 rotates in a perpendicular plane as shown in FIG. 7A in order to engage the recess 710 of the lock latch 500 to lock the backpack. FIG. 7B shows the stowed position where the backpack is unlocked and the catch 700 prevents the lock latch 500 from rotating back down and locking the backpack. On the other hand, when the backpack is locked, the end of the lock latch 500 fits into an opening 530 on the moving frame 510 and the catch 700 fits into the recess 710 on the lock latch 500 and prevents the lock latch 500 from disengaging. The lock latch 500 may be an L-shaped piece of metal or hard plastic that is attached to the fixed frame 200 and swings out to engage the recess 530 in the moving frame 510 as described. When the lock latch 500 is engaged in the recess 530, it prevents the moving frame 510 from moving relative to the fixed frame 200.

To move the backpack from a locked to an unlocked position, the catch 700 is rotated out of the recess 710 in the lock latch 500. A bounce of the backpack then knocks the lock latch 500 out of the recess 530. At this point, the catch 700 is moved in under the lock latch 500 to drive the lock latch 500 into the stowed position seen in FIG. 7B. Thus, there is cam action in both movements. When locking, the catch 700 and the recess 710 in the lock latch 500 are set so that the lock latch 500 is pushed in. When unlocking, the sloped shape of the lock latch 500 enables the catch 700 to push the lock latch 500 out of the way and to stow it.

Figure 8A:
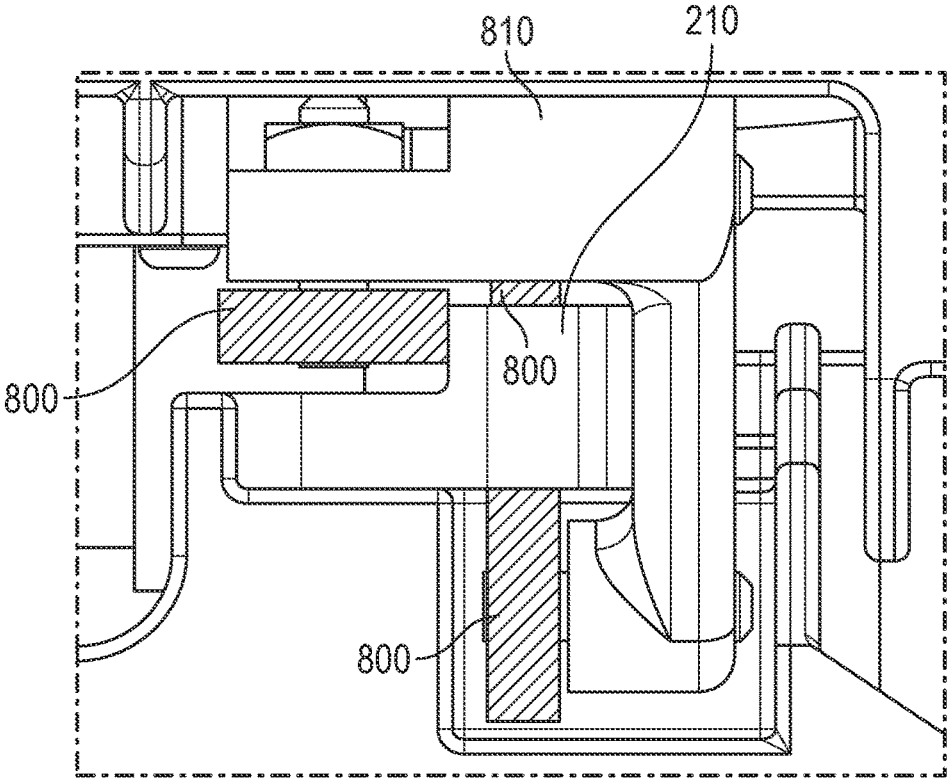
FIG. 8A illustrates an enlarged view of the wheel and rail mechanism illustrated in FIG. 8B.
Figure 8B:
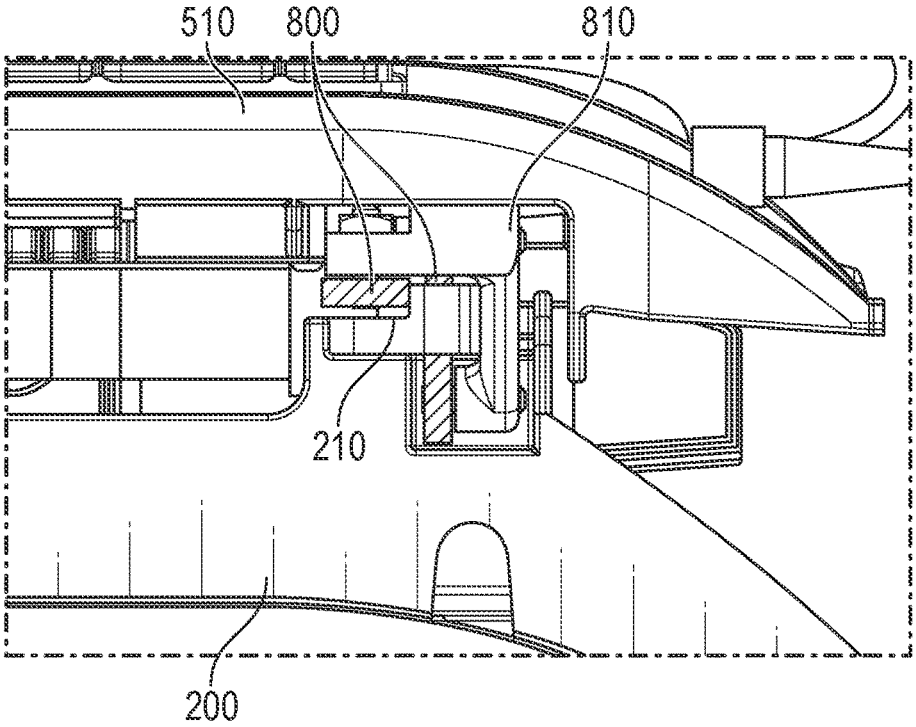
FIG. 8B illustrates a sample embodiment of a wheel and rail mechanism that permits movement of the load relative to the fixed frame.

FIG. 8A illustrates an enlarged view of the wheel and rail mechanism illustrated in FIG. 8B, which illustrates a sample embodiment of a wheel and rail mechanism that permits movement of the load relative to the fixed frame 200. FIGS. 8A and 8B show bottom views of the fixed frame 200 and the moving frame 510 positioned such that the wearer's back would be at the bottom of the respective figures. The moving frame 510 moves along the rail 210 of the fixed frame 200 using wheels 800 that are disposed on three sides of the rail 210 to limit lateral movement of the moving frame 510 relative to the rail 210. The wheels 800 are held by a wheel mount 810 that provides sufficient pressure to hold the wheels 800 in a slot of the rail 210. In sample embodiments, the rails 210 are molded into the plastic frame of the fixed frame 200 to reduce their cost and weight. In use, the moving frame 510 would move into and out of the page along rail 510 using wheels 800. By using wheels 800 on three sides of the rail as illustrated, the moving frame 510 is prevented from separating from the fixed frame 200 during movement of the moving frame 510.

In a sample embodiment, the rails 210 may have a rectangular cross-section. The rails 210 are mounted to the fixed frame 210 at the top and bottom of the rail 210. The wheels 800 mount to three different surfaces of the rail 210 and the wheel mount 810 wraps around a fourth surface of the rail 210. In this way the wheels 800 cannot be separated from the rail 210 during use.

Figures 9A, 9B:
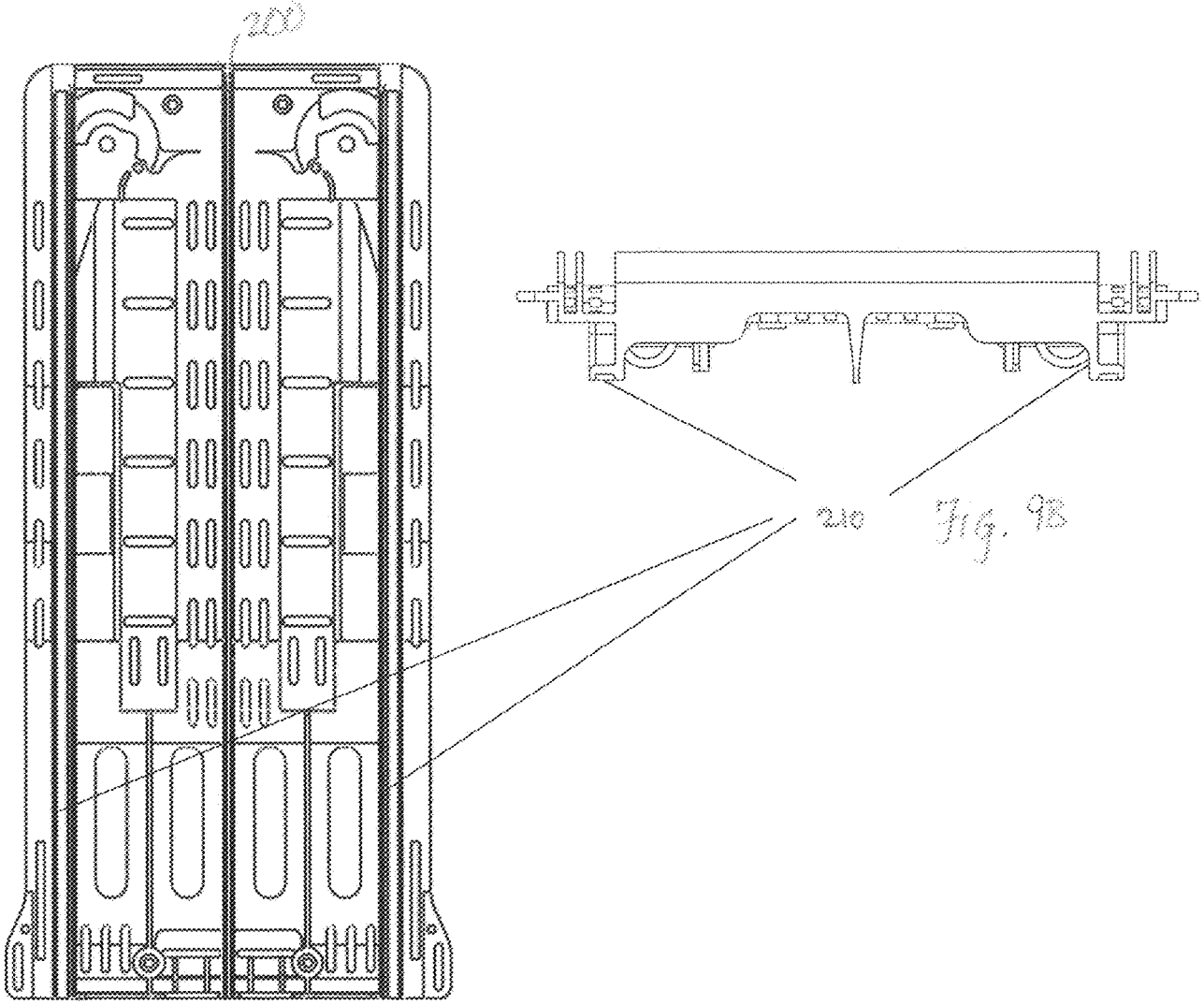
FIG. 9A illustrates a rear view of the fixed frame of the backpack, including the modified rail system.
FIG. 9B illustrates a bottom view of the fixed frame of FIG. 9A, showing the rail system from a bottom view.

FIG. 9A illustrates a rear view of the fixed frame of the backpack, including the modified rail system 210, while FIG. 9B illustrates a bottom view of the fixed frame of FIG. 9A, showing the rail system 210 from a bottom view. Like the embodiment of FIG. 2, the embodiment of FIGS. 9A and 9B includes two identical bungee systems in parallel to provide a greater range of forces. As described with respect to FIGS. 8A and 8B, the moving frame 510 is positioned such that the wheels 800 engage the rail system 210 on three sides to prevent separation of the moving frame 510 from the fixed frame 200 during certain loading conditions. Also, in the embodiment of FIGS. 9A and 9B, the rails 210 are molded into the fixed frame 200 to keep the rail weight and cost much lower than if the rails 210 were bolted to the fixed frame 200. In sample embodiments, the fixed frame 200 and the rails 210 may be injection molded by including the rail feature in the mold. When plastic is injected into the mold, the fixed frame 200 comes out with the rails 210 integrally attached to the fixed frame 200. Because the rails 210 are made in the same step as the fixed frame 200, they are less expensive, they are also lighter because there is no additional hardware needed to attach the rails 210 to the fixed frame 200. The molded rail configuration thus makes the backpack less expensive, lighter, and easier to manufacture. It will be appreciated that all mechanical parts described herein may be made from either injection molded plastic parts or machined plastic and/or metal parts.

Also, in sample embodiments, the rail system 210 is split so that the two frames 200 and 510 may be separated quickly and easily without unbolting the rails 210 from the fixed frame 200. A stop may be used to prevent the wheels 800 from traveling to the split opening in the rails to prevent the wheels 800 from becoming disengaged from the track 210. To separate the two frames 200 and 510, the stop is removed and the wheels 800 are then moved to the split opening for disengagement.

Other modifications may be made to the backpack assembly to improve performance. For example, by using more pulleys 40, the fixed frame 200 may be shortened to make the backpack less cumbersome and more practical. Adding additional pulley wheels 40 to the bungee mechanism permits the total length of the bungee cord 20 to be longer while also having a shorter frame. For example, moving from two to three pulley wheels 40 allows the bungee cord 20 to be significantly longer than the fixed frame 200 to keep the total frame length manageable while still allowing the bungee code 20 to be long enough to properly operate. The ratchet mechanism 230 described herein makes such a configuration practical as the ratchet mechanism 230 will enable the user to apply the additional force that would be necessary to tighten the bungee cord 20 over additional pulleys. This configuration thus allows for a long bungee cord 20 but also a fixed frame 200 of moderate length, making the resulting backpack more suitable for use as a smaller day pack.

The backpack described herein thus improves upon the ergonomic suspended load backpack described in U.S. Pat. No. 7,931,178. The features described herein make such backpacks simpler and much easier to operate, as well as more cost effective to manufacture. The features described herein also makes such backpacks more rugged and less likely to separate.

It will also be appreciated that items, such as the rail and locking mechanism, described as being mounted on the fixed frame 200, may alternatively be mounted on the moving frame 510. Conversely, items such as the wheels 800 described as being mounted on the moving frame 510 may be mounted on the fixed frame 200 to interact with one or more rails on the moving frame 510.

Throughout this specification, plural instances may implement components, operations, or structures described as a single instance. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

The above description is intended to be illustrative, and not restrictive. For example, the above-described examples (or one or more aspects thereof) can be used in combination with others. Other examples can be used, such as by one of ordinary skill in the art upon reviewing the above description. The Abstract is to allow the reader to quickly ascertain the nature of the technical disclosure, for example, to comply with 37 C.F.R. § 1.72(b) in the United States of America. It is submitted with the understanding that it will not be used to interpret or limit the scope or meaning of the claims.

Also, in the above Detailed Description, various features can be grouped together to streamline the disclosure. However, the claims cannot set forth every feature disclosed herein, as examples can feature a subset of such features. Further, examples can include fewer features than those disclosed in a particular example. Thus, the following claims are hereby incorporated into the Detailed Description, with each claim standing on its own as a separate example. The scope of the examples disclosed herein is to be determined with reference to the appended claims, along with the full scope of equivalents to which such claims are entitled.

The invention claimed is:

1. A suspended load backpack, comprising:

a moving frame including a bag for receiving a load to be carried by the backpack;

a fixed frame including shoulder straps for holding the fixed frame in place on a wearer's back;

a rail assembly that connects the moving frame to the fixed frame but allows the moving frame to move relative to the fixed frame;

a mounting wheel connected to the fixed frame;

a compliant mechanism that is connected between the fixed frame and the moving frame and wrapped around the mounting wheel to permit movement of the moving frame relative to the fixed frame during a gait of the wearer of the backpack in accordance with tension on the compliant mechanism;

a ratchet assembly including a lever that rotates the mounting wheel to apply tension to the compliant mechanism to adjust a spring constant of the compliant mechanism; and a locking mechanism that locks the moving frame to the fixed frame at a first locking position to prevent movement, the locking mechanism comprising a lock latch connected to the fixed frame via a lock pivot pin that allows the lock latch to swing and to engage a lock recess in the moving frame.

2. A suspended load backpack as in claim 1, wherein the compliant mechanism is a bungee cord, further comprising a tube adjacent the mounting wheel and adapted to receive the bungee cord as the bungee cord is extended during ratcheting by the ratchet assembly.

3. A suspended load backpack as in claim 1, wherein the ratchet assembly includes a ratchet wheel, a first pawl attached to the lever and that provides a mechanical connection between the mounting wheel and the lever, a first pawl spring that keeps the first pawl engaged with the mounting wheel when the lever is being rotated to an initial position, a second pawl attached to the fixed frame so as to prevent the mounting wheel from spinning while the lever is advanced to the initial position, and a second pawl spring that keeps the second pawl engaged with the mounting wheel when the lever is being rotated to the initial position.

4. A suspended load backpack as in claim 3, wherein the compliant mechanism is a bungee cord, and wherein movement of the lever cranks the mounting wheel to apply tension to the bungee cord as the mounting wheel rotates about a shaft mounted to the fixed frame as the lever rotates about the shaft.

5. A suspended load backpack as in claim 4, wherein the first pawl engages the mounting wheel as the lever rotates the mounting wheel to apply tension to the bungee cord.

6. A suspended load backpack as in claim 1, wherein the ratchet assembly is located at a bottom of the fixed frame.

7. A suspended load backpack as in claim 1, further comprising a second recess in the moving frame for providing a second locking position to prevent movement.

8. A suspended load backpack as in claim 1, wherein the lock latch comprises a recess, further comprising a catch that is configured to rotate in a perpendicular plane relative to the lock latch in order to engage with the lock recess in a locked position.

9. A suspended load backpack as in claim 8, wherein the catch is configured to rotate in a perpendicular plane relative to the lock latch in order to disengage with the lock recess in an unlocked position and to rotate so as to prevent the lock latch from rotating back into the locked position.

10. A suspended load backpack as in claim 1, wherein the rail assembly comprises at least one rail mounted to the fixed frame and wheels connected to the moving frame, wherein the wheels are disposed on three sides of the at least one rail to limit lateral movement of the moving frame relative to the at least one rail.

11. A suspended load backpack as in claim 1, wherein the rail assembly comprises at least one rail molded integrally with the fixed frame.

12. A suspended load backpack as in claim 1, wherein the rail assembly comprises at least one rail mounted to the fixed frame at a top and bottom of the rail.

13. A suspended load backpack as in claim 1, wherein the compliant mechanism is a bungee cord, further comprising at least two pulleys around which the bungee cord is wound.

14. A suspended load backpack comprising:

a moving frame including a bag for receiving a load to be carried by the backpack;

a fixed frame including shoulder straps for holding the fixed frame in place on a wearer's back;

a rail assembly that connects the moving frame to the fixed frame but allows the moving frame to move relative to the fixed frame;

a mounting wheel connected to the fixed frame;

a compliant mechanism that is connected between the fixed frame and the moving frame and wrapped around the mounting wheel to permit movement of the moving frame relative to the fixed frame during a gait of the wearer of the backpack in accordance with tension on the compliant mechanism;

a ratchet assembly including a lever that rotates the mounting wheel to apply tension to the compliant mechanism to adjust a spring constant of the compliant mechanism; and a spring-loaded latch that automatically engages to lock the moving frame relative to the fixed frame at a topmost position of movement of the moving frame relative to the fixed frame.

* * * * *